US005609211A

United States Patent [19]

Meyer et al.

[11] Patent Number: 5,609,211

[45] Date of Patent: Mar. 11, 1997

[54] EXTENDED COVERAGE AUTOMATIC CEILING SPRINKLER

[75] Inventors: George G. Meyer; Stephen J. Meyer, both of Malvern; George S. Polan, Harleysville; Kevin Dolan, North Wales, all of Pa.

[73] Assignee: Central Sprinkler Company, Lansdale, Pa.

[21] Appl. No.: 408,854

[22] Filed: Mar. 22, 1995

Related U.S. Application Data

[63] Continuation-in-part of Ser. No. 342,465, Nov. 21, 1994, which is a continuation of Ser. No. 875,928, Apr. 29, 1992, Pat. No. 5,366,022, which is a continuation-in-part of Ser. No. 769,917, Sep. 30, 1991, abandoned.

[51] Int. Cl.[6] ..... A62C 37/08

[52] U.S. Cl. ..... 169/37; 169/16

[58] Field of Search ..... 169/37, 38, 16, 169/17; 239/498

[56] References Cited

U.S. PATENT DOCUMENTS

| | | | |
|---|---|---|---|
| D. 251,128 | 2/1979 | Groos et al. | D23/6 |
| D. 348,719 | 7/1994 | Dolan | D23/214 |
| 2,279,374 | 4/1942 | Jung | 239/498 |
| 2,550,456 | 4/1951 | De Flon | 239/498 |
| 2,697,008 | 12/1954 | Rowley | 299/121 |
| 2,724,614 | 11/1955 | Rider | 299/121 |
| 3,682,251 | 8/1971 | Livingston | 169/37 |
| 3,722,596 | 8/1973 | Livingston . | |
| 3,802,512 | 4/1974 | Todtenkopf | 169/37 |
| 3,874,455 | 4/1975 | Klesow | 169/19 |
| 3,888,313 | 6/1975 | Freeman | 169/37 X |
| 3,904,126 | 9/1975 | Allard . | |
| 4,066,129 | 1/1978 | Anderson | 169/37 |
| 4,099,675 | 7/1978 | Wohler et al. | 169/37 X |
| 4,136,740 | 1/1979 | Groos et al. | 169/39 |
| 4,279,309 | 7/1981 | Fischer et al. | 169/37 |
| 4,405,018 | 9/1983 | Fischer | 169/37 |
| 4,569,289 | 2/1986 | Gielow et al. | 105/2 R |
| 4,580,729 | 4/1986 | Pounder | 239/524 |
| 4,624,414 | 11/1986 | Ferrazza | 239/467 |
| 4,699,217 | 10/1987 | McLennan et al. | 169/37 |

(List continued on next page.)

FOREIGN PATENT DOCUMENTS

| | | | |
|---|---|---|---|
| 1252143 | 12/1960 | France | 169/37 |
| 6400053 | 7/1964 | Netherlands | 169/37 |
| 765125 | 1/1957 | United Kingdom . | |
| 2177912 | 2/1987 | United Kingdom | 169/37 |
| 2206043 | 12/1988 | United Kingdom | 169/37 |

OTHER PUBLICATIONS

Sheet entitled "Grinnell Jumbo Sprinkler Issue A", Grinnell Corp., Feb. 1969, (1 page).

(List continued on next page.)

*Primary Examiner*—Gary C. Hoge

*Attorney, Agent, or Firm*—Panitch Schwarze Jacobs & Nadel, P.C.

[57] ABSTRACT

An extended coverage ceiling sprinkler includes a generally tubular body having an inlet open end and an opposing, outlet open end with a minimal internal diameter greater than 0.65 inches and a K-factor of between about 14 and about 15. A plug at least essentially closes the outlet open end and an element releasably retains the plug in the outlet end. A deflector support extends away from the outlet end of the tubular body and a deflector is coupled to the tubular body through the deflector support. The deflector has a major surface facing, spaced from and aligned with the outlet open end with a circular outer perimeter less than 1.7 inches in outer diameter and a central area without water passing openings therethrough at least 0.75 inches in diameter. Slots extend generally radially inwardly from the perimeter and surround the central area which is slotless. The ratio of deflector outer diameter to slot depth is greater than 10 and up to about 14. Diametrically opposed pairs of imaginary projections extended tangentially from the major surface of the deflector facing the outlet open end, from between adjoining pairs of slots, and define an acute angle facing the outlet open end of between about 80° and about 100°.

7 Claims, 4 Drawing Sheets

U.S. PATENT DOCUMENTS

| | | | |
|---|---|---|---|
| 4,791,993 | 12/1988 | Curran | 169/37 X |
| 4,800,961 | 1/1989 | Klein . | |
| 4,880,063 | 11/1989 | Leininger et al. | 169/37 |
| 4,901,799 | 2/1990 | Pepi et al. | 169/37 X |
| 4,923,013 | 5/1990 | De Gennaro | 169/37 X |
| 4,930,578 | 6/1990 | Barnett et al. | 169/39 |
| 4,964,574 | 10/1990 | Daigle . | |
| 5,020,601 | 6/1991 | Retzloff et al. | 169/37 |

OTHER PUBLICATIONS

Drawing entitled "Grinnell Large Capacity Protectospray Nozzle Type D–3 Frame", B–1800, Grinnell Corporation, Jun., 1981 (1 page.).

Drawing entitled "grinnell Large Capacity Protectospray Nozzle Type D–3 Assembly", B–1801, Grinnell Corporation, Jun., 1981 (1 page).

Drawing entitled "Grinnell Protectospray Nozzle Type D–3, D–4 Splitter" and A 7023, Grinnell Corporation, Dec., 1966 (1 page).

Drawing entitled "Grinnell Large Capacity Protectospray Nozzle Type D–3 Deflector" and A–3780, Grinnell Corporation, Jan., 1964 (1 page).

Collection of figures, FIG. 1–FIG. 7 entitled "Types D–3 and D–4a Protectospray Nozzles", FIG. 8–FIG. 9 entitled Type D3 Large Capacity Protectospray Nozzles and FIG. 10–FIG. 13 entitled Type EA–1 Protectospray Nozzles, Grinnell Corporation, Sep., 1985 (13 pages).

Bulletin No. 211 entitled "Sprinklers, Nozzles And Accessories/Section 4 Duraspeed® Sprinkler–Rack Storage–Q–17", Grinnell Corporation, Jan., 1975 (2 pages).

Bulletin No. 301 entitled "Sprinklers, Nozzles And Accessories / Section 4 Quartzoid Sprinkler –Large Orifice Styles: Pendent–Upright–Old Style", Grinnell Fire Protection Systems Company, Inc., Dec., 1973, (2 pages).

Sheet entitled "Grinnell Quartzoid Sprinkler, Issue D Large Orifice –¾" N.P.T. Connection", Grinnell Corporation, Sep., 1971 (1 page).

Sheets entitled "Large Orifice Upright & Pendent Sprinklers Issue D Bulb Type, 17/32 Orifice–½" N.P.T. Connection", Grinnell Corporation, Aug., 1978, (2 pages).

Bulletin No. 305 entitled "Sprinklers Nozzles And Accessories/Section 4 Quartzoid Pull Type Sprinkler Style: Pendent, Upright, Old Style", Grinnell Fire Protection Systems Company, Inc., Jul., 1974, (2 pages).

Sheet entitled Grinnell Quartzoid Sprinkler, Issue D Pull Type, Grinnell Corporation, Sep., 1971 (1 page).

Sheet entitled "Grinnell Quartzoid Sprinkler Issue–D", Grinnell Company, Inc., Nov., 1959, (1 page).

Sheet entitled "Grinnell Q16 Sprinklers Engineering Data", Grinnell Corporation, Sep., 1971 (1 page).

Viking Technical Data sheet entitled "High Challenge™ Upright Sprinkler", The Viking Corp., Mar., 1977 (1 page).

Equipment Application Data sheets entitled "High Challenge® Sprinklers/Application Report: Digital Equipment Corporation", the Viking Corp., May, 1986 (4 pages).

N. J. Thompson, *Fire Behavior And Sprinklers,* Chapter 6 "Automatic Sprinkler Protection", National Fire Protection Association, 1964, Cover, Foreward, Table of Contents and pp. 72–91.

Newsletter for Fire Protection Engineers And Industry, No.11, Jul., 1965, Orinda, California (8 pages).

Technical Report entitled "Optimization of Sprinkler Protection For United States Postal Service III. Protection Of Plastic Letter Trays", Factory Mutual Research Corporation, Oct. 1971 (39 pages).

Technical Report No. AFWL–TR–72–entitled "Fire Protection Study USAF Mobility Program Structures And Large Air Force Warehouses Phase 2", Factory Mutual Research Corporation, Nov., 1972 (65 pages, with cover and introductory pages).

Technical Report entitled "Protection Of Idle Polyethylene Plastic Palettes With Viking Prototype Sprinklers (0.64 in. Orifice)", Factory Mutual Research Corporation, Jan., 1974, (29 pages with cover and introductory pages).

Technical Report entitled "Optimization Of Sprinkler Protection For United States Postal Facilities/IV Protection Of Plastic Letter Trays With 0.64–In. Retrofit Sprinklers", Factory Mutual Research, Jul., 1974 (30 pages with cover and introductory pages).

Technical Report entitled "Development Of Large Drop Sprinklers (0.64–In. Orifice Diameter)", Factory Mutual Research Corp., Jun., 1976 (38 pages including cover and introductory pages).

SFTE Bulletin, 77–2, April, 1977, Boston, MA, ( pp. 1, 7 and 8).

"File Ex643 Project 80NK16583 Report on Automatic Sprinklers", Underwriters Laboratories, Inc., May, 1981 (18 pages).

Technical Report entitled "Large–Drop Automatic Sprinklers", Factory Mutual Research Corp., Feb., 1982 (76 pages with cover and introductory pages).

*Fire Protection Handbook Fifteenth Edition,* National Fire Protection Association, Sep., 1981, Title Sheet, Inner Sheet and pp. 17–32 through 17–40.

*Fire Protection Handbook, Sixteenth Edition,* National Fire Protection Association, Mar., 1986 (Title Sheet, Inner Sheet, Table of Contents p. xi and pp. 18–2 through 18–26, 18–36 through 18–59 and 18–77 through 18–82).

*Approved Product News,* Factory Mutual Engineering Corp., vol. 4, No. 2, Dec., 1988, pp. 1–5, 8–12 and 16.

*Fire Protection Handbook, Seventeenth Edition,* National Fire Protection Association, 1991, Title page, inner page, Table of Contents p. ix and pp. 5–127 through 5–163 and 5–174 through 5–197.

*Sprinkler Tech Notes,* National Fire Sprinkler Association, Inc., vol. XVII, Nov. 5, Dec., 1994 (12 pages).

New Product Announcement, "Model G and GFR XLO Extended Coverage Ordinary Hazard Sprinklers", The Reliable Automatic Sprinkler Co., Inc., Mar., 1993, (one page).

Bulletin 128, "Model G XLO–ECOH Model GFR XLO–ECOH Extended Coverage Ordinary Hazard Pendent and Recessed Pendent Sprinklers", The Reliable Automatic Sprinkler Co., Inc., Feb., 1993, (2 pages).

Bulletin 128, Addendum, "Model G and GFR Ecoh Pendent And Recessed Pendent Sprinklers Design Criteria Addendum", The Reliable Automatic Sprinkler Co., Inc., Mar., 1993 (one page).

Bulletin 124, "Model G XLO–ECOH Extended Coverage Ordinary Hazard Upright Sprinkler", The Reliable Automatic Sprinkler Co., Inc., Jul., 1993 (2 pages).

Grinnell Product Bulletin entitled "Extended Coverage Ordinary Hazard Sprinklers Pendent & Recessed Pendent Model F987 Designer, K=11.4", Grinnell Corporation, Oct., 1993 (5 pages).

Viking Technical Data sheet entitled "Model M Extended Coverage Ordinary Hazard Extra Large Orifice Sprinkler", The Viking Corporation, Jun., 1993, (pp. 83a–83c).
Viking Technical Data sheet entitled "Model M Extended Coverage Light Hazard Extra Large Orifice Sprinkler", The Viking Corporation, Jan., 1994, (pp. 85a–85c).
Viking Technical Data sheet entitled "Model M Quick Response Extended Coverage Light Hazard Extra Large Orifice Sprinkler", The Viking Corporation, Jan., 1994, (pp. 71a–71c).
Central Sprinkler Corp. drawing for "Deflector, Upright/.64 Orifice Sprinkler", last amended Nov. 18, 1986, Drawing No. B–131–09 Rev. 6.
Sample Central Sprinkler Corp. D–64 Sprinkler with upright deflector of Drawing B–131–09 Rev. 6.
Underwriters Laboratories, Inc., UL 199, Standard For Automatic Sprinklers For Fire Protection Service, Eighth Edition, Feb., 1990.
National Fire Protection Association, (NFPA) 13, Installation Of Sprinkler Systems, Feb., 1989.
Underwriters Laboratories, Inc., UL 1626, Standard For Safety–Residential Sprinklers For Fire–Protection Service, First Edition, Apr. 1988.
Factory Mutual Research, Approval Standard For Automatic Sprinklers For Fire Protection Service, Dec., 1983.
"Product Profile–First U.L. Listed Extended Coverage Ordinary Hazard Sprinklers", Fire Protection Contractor, May, 1992, (cover, pp. 46–50).
Factory Mutual Research, Approval Standard, Large Drop Sprinklers, Class No. 2007, Sep. 1979.
Factory Mutual, Loss Prevention Data, 2–7, "Installation Rules for Sprinkler Systems Using Large–Drop Sprinklers", Mar., 1990.
Underwriters Laboratories, Inc., UL 1767, Standard For Safety, Early–Suppression Fast–Response Sprinklers, First Edition, Feb. 1990.
Factory Mutual, Loss Prevention Data, 2–2, "Early Suppression Fast Response Sprinklers", Apr., 1987.
Factory Mutual, Approval Standard, Early Suppresion Fast Response Automatic Sprinklers, Jun., 1986.
Viking, Technical Data, "Quick Response High Challenge Large Drop Sprinklers", Sprinkler, Jul. 26, 1989, pp. 115–116.
Data Sheet, ASCOA Fire Systems, "Automatic ESFR Glass Bulb Sprinkler", Mar., 1992, (pp. 1.1–1.2).
Grinnell Corporation, Data Sheet, "Early Suppression Fast Response Sprinklers, Model ESFR–1 Pendent, 14.3 K–FActor".
Reliable, Product Announcement, "ESFR, Model H, Early Suppression Fast Response Sprinkler", Oct., 1992.
Viking, Technical Data, "Aquamiser Model B Quick Response Specific Application Sprinkler", Sprinkler, May 31, 1991, pp. 117a, 117b, 117c.
Central Sprinkler Corporation, "The Omega' Commercial/Residential Quick Response Automatic Sprinkler, Model EC–20 Pendent", Aug., 1985.
NFPA, 1986 Fall Meeting, "Technical Committee Reports", pre–May, 1986, (cover, pp. 424–425).
NFPA, 1986 Fall Meeting, "Technical Committee Documentation", Nov., 1986, (cover, pp. 88–90, 11).
Reliable, "Model GXLO–ECOH, Model GFR XLO–ECOH, Extended Coverage Ordinary Hazard Sprinklers", Bulletin 128, (2 pages).
Central Sprinkler Corporation, Test Results For Extended Coverage Ordinary Hazard.
Central Sprinkler Corporation, Videotape (VHS), "The Optima Sprinklers, Extended Coverage Ordinary Hazard Sprinkler Testing (ELO–16, ESLO–20)".
Advertisement for Aquamiser™; The Viking Corporation, 210 N. Industrial Park Road, Hastings, MI 49058. (undated).
Central Sprinkler catalog insert for Omega™ EC–20A (EC–20A 4–87); Central Sprinkler Corporation, 451 North Cannon Ave., Lansdale, PA 19446. Apr., 1987.
Central Sprinkler Bulletin AS–D.64 Rev. No. 3 "Extra Large Orifice Automatic Sprinkler Model 'D.64' Upright"; Central Sprinkler Corporation. Aug., 1985.
"Adjustable Royal Flush Concealed Sprinkler Model '76A'", Bulletin RFS–76A Rev. No. 7, Sep. 1984, Central Sprinkler Corporation, Lansdale, PA, (2 pages).

EXTENDED COVERAGE AUTOMATIC CEILING SPRINKLER

This application is a continuation-in-part of application Ser. No. 08/342,465, filed on Nov. 21, 1994, which is a continuation of application Ser. No. 08/875,928,filed on Apr. 29, 1992, now U.S. Pat. No. 5,366,022, which is a continuation-in-part of application Ser. No. 07/769,917, filed on Sep. 20, 1991, now abandoned.

FIELD OF THE INVENTION

The present invention relates to automatic ceiling sprinklers and, more particularly, to extended coverage ceiling sprinklers with larger than large orifices.

BACKGROUND OF THE INVENTION

In 1991 Central Sprinkler Co. demonstrated that extended coverage could be provided for ordinary hazard protection utilizing sprinklers with extra large orifices having diameters between about 0,625 and 0.64 providing K-factors of between about 11.2 and about 11.4. These sprinklers provided fire protection over extended coverage areas (greater than 130 sq. ft. per sprinkler) superior to that which was provided by then existing standard orifice, standard spray ceiling sprinklers over standard coverage areas (up to 130 sq. ft.). This improved fire protection could be achieved at reduced costs as the extended coverage areas permitted the use of fewer sprinkler runs and wider spacing of sprinklers on runs. Reduced cost provided an additional benefit. As the cost of sprinkler installations decline, they become more economically viable to install. Reduced costs not only led to savings by sprinkler system purchasers, it is believed this improved capability and reduced cost has fostered more widespread use of automatic ceiling sprinkler systems, at least for ordinary hazard protection.

Shortly after extended coverage was demonstrated for extra large orifice sprinklers, it was further demonstrated for very extra large orifice sprinklers having nominal (i.e. minimum) orifice diameters of between about 0.69 and 0.71 inches providing K-factors of between about 14.0 and about 14.5. These very extra large orifice extended coverage sprinklers provided coverage for the maximum permitted protection areas (up to 400 sq. ft.) at the lowest minimum required operating pressures (less than 35 psi) for the highest water densities (0.21 GPM/ft$^2$). This made extended coverage ordinary hazard protection over the maximum permitted protection areas available at virtually all ordinary hazard installations without the need of auxiliary pumps to boost the pressure of water typically supplied to such installations.

Since the introduction of extended coverage ordinary hazard automatic sprinkler protection, improvements in such sprinklers have been directed to reducing their size for aesthetic purposes and reducing the minimum spacing permitted between sprinklers, which makes such sprinklers more easy to install. Minimum spacing is determined by "cold solder" testing. It is the minimum distance which can be used safely between identical sprinklers without the discharge from one sprinkler hitting the adjoining sprinkler and cooling that sprinkler to sufficiently prevent it from actuating when it should. Minimum permitted spacing for the first very extra large orifice, extended coverage ceiling sprinklers was 16 feet. That has been improved to 15 feet. This permits such sprinklers to be used at 16×16 ft. spacings in tiled ceiling buildings using standard 2×4 ft. tiles). Such sprinklers would be more versatile if, in addition to being capable of being used at maximum spacings of up to 20 feet, they could be used at minimum spacings less than 15 feet, particularly minimum spacings of 12 feet or even as low as 8 feet, both of which work well with standard tile ceilings.

SUMMARY OF THE INVENTION

An extended coverage ceiling sprinkler comprising: a generally tubular body having an inlet open end and opposing, outlet open end, the tubular body having a minimum internal diameter greater than 0.65 inches and a K-factor of between about 14 and about 15, where the K-factor equals the flow of water in gallons per minute through the tubular body divided by the square root of the pressure of the water fed to the tubular body in pounds per square inch; a plug at least essentially closing the outlet end of the tubular body; an element releasably retaining the plug in the outlet end at least essentially closing the outlet end; a deflector support extending axially away from the outlet end of the tubular body; and a deflector coupled to the tubular body through the deflector support, the deflector having a major surface facing, spaced from and generally aligned with the outlet open end of the tubular body, the deflector having a circular outer perimeter and an outer diameter of less than 1.7 inches and, as mounted with the deflector support, a central area without water passing openings therethrough, the central area of the deflector being at least 0.75 inches in diameter.

An extended coverage ceiling sprinkler comprising: a generally tubular body having an inlet open end and opposing, outlet open end, the tubular body having a minimum internal diameter greater than 0.6 inches and a K-factor greater than 9 and up to about 15, where the K-factor equals the flow of water in gallons per minute through the tubular body divided by the square root of the pressure of the water fed to the tubular body in pounds per square inch; a plug at least essentially closing the opposing outlet end of the tubular body; an element releasably retaining the plug in the outlet end at least essentially closing the outlet end; a deflector support extending axially away from the one end of the tubular body; and a deflector coupled to the tubular body through the deflector support, the deflector having a major surface facing, spaced from and generally aligned with the outlet end of the tubular body, the deflector having a circular outer perimeter with a plurality of slots extending axially through the deflector and generally radially inwardly from the perimeter towards a central axis of the deflector and, as mounted with the deflector support, a slotless central area without water passing openings therethrough, the slotless central area of the deflector being at least 0.75 inches in diameter, wherein a ratio of the area of the slots in a plane perpendicular to the central axis is between ten percent (10%) and thirty percent (30%) of the total area in the plane surrounded by the circular outer perimeter less the area of the slots.

An extended coverage ceiling sprinkler comprising: a generally tubular body having an inlet open end and opposing, outlet end, the tubular body having a minimum internal diameter greater than 0.65 inches and a K-factor of between about 14 and about 15, where the K-factor equals the flow of water in gallons per minute through the tubular body divided by the square root of the pressure of the water fed to the tubular body in pounds per square inch; a plug at least essentially closing the opposing outlet end of the tubular body; an element releasably retaining the plug in the outlet end at least essentially closing the outlet end; a deflector support extending axially away from the outlet end of the tubular body; and a deflector coupled to the tubular body through the deflector support, the deflector having a major surface facing, spaced from and generally aligned with the outlet end of the tubular body, the deflector having a circular outer perimeter and an outer diameter of less than 1.7 inches with a plurality of slots extending axially through the deflector and generally radially inwardly from the perimeter toward a central axis of the deflector and, as mounted with the deflector support, a slotless central area without water passing openings therethrough, wherein a ratio of the deflector outer diameter to slot depth of at least one of the slots in a direction perpendicular to the central axis is greater than 10.

An extended coverage ceiling sprinkler comprising: a generally tubular body having an inlet open end and opposing, outlet open end, the tubular body having a minimum internal diameter greater than 0.6 inches and a K-factor of greater than 9 and up to about 15, where the K-factor equals the flow of water in gallons per minute through the tubular body divided by the square root of the pressure of the water fed to the tubular body in pounds per square inch; a plug at least essentially closing the opposing outlet end of the tubular body; an element releasably retaining the plug in the outlet end at least essentially closing the outlet end; a deflector support extending axially away from the one end of the tubular body; and a deflector coupled to the tubular body through the deflector support, the deflector having a major surface facing, spaced from and generally aligned with the outlet end of the tubular body, the deflector having a circular outer perimeter with a plurality of slots extending axially through the deflector and generally radially inwardly from the perimeter toward a central axis of the deflector and, as mounted with the deflector support, a slotless central area without water passing openings therethrough, the slotless central area of the deflector being at least 0.75 inches in diameter, and diametrically opposed pairs of imaginary projections extended tangentially from the deflector between adjoining pairs of slots on diametrically opposing sides of the major surface of the deflector facing the outlet open end, the projections intersecting one another at about the central axis and defining an angle facing the outlet end of the tubular body of between about 80° and about 100°.

BRIEF DESCRIPTION OF THE DRAWINGS

The foregoing summary as well as the following detailed description of preferred embodiments will be better understood when made in conjunction with the appended drawings. For the purpose of illustrating the invention, there is shown diagrammatically in the drawings, embodiments which are presently preferred. It should be understood, however, that the invention is not limited to the specific embodiments, instrumentalities, elements and methods disclosed in the drawings.

DETAILED DESCRIPTION OF PREFERRED EMBODIMENTS

Figure 1:
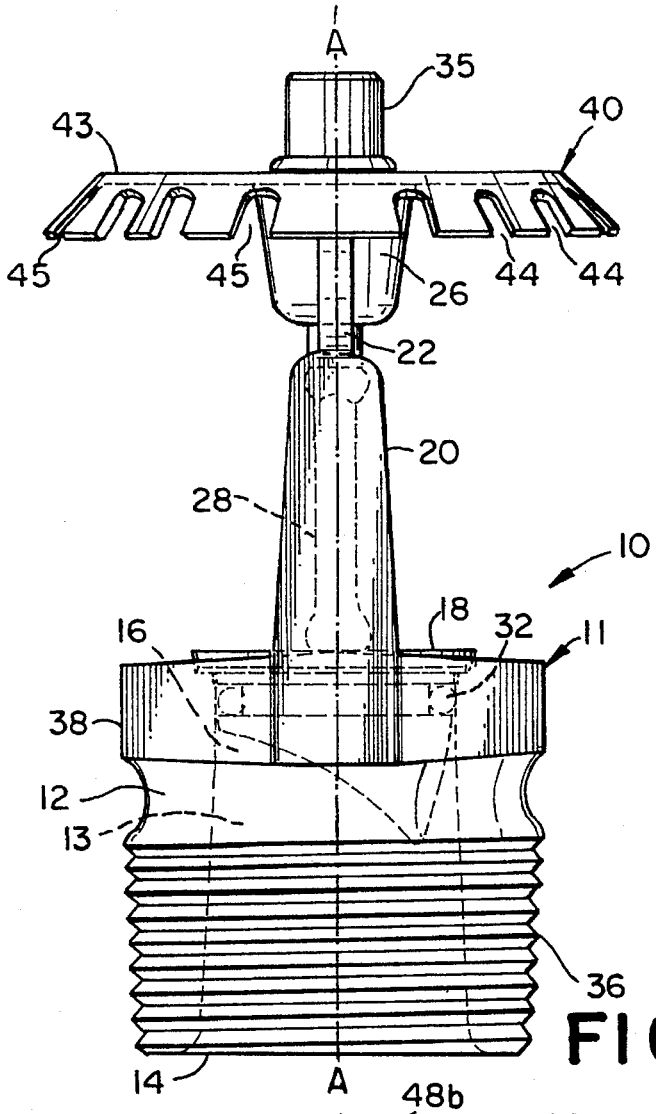
FIG. 1 is a side elevational view of a pendent extended coverage ordinary hazard automatic ceiling sprinkler of the present invention.

Certain terminology is used in the following description for convenience only and is not intended to be limiting. The words "right", "left", "lower" and "upper" designate directions in the drawings to which reference is made. The words "radial" and "axial" refer to directions perpendicular to and along the central axis of an object, element or structure referred to are the words "inwardly" and "outwardly" refer to directions towards and away from, respectively, the geometric center of the object, element or structure. The terminology includes the words above specifically mentioned, derivatives thereof and words of similar import. Moreover, throughout the drawings, like numerals are used to indicate like elements.

Incorporated by reference in their entireties are application Ser. Nos. 08/227,430 filed Apr. 14, 1994, and Ser. No. 08/324,465 filed Nov. 21, 1994, which are continuations-in-part of application Ser. No. 07/875,928 filed Apr. 29, 1992, now U.S. Pat. No. 5,366,022, which is a continuation-in-part of application Ser. No. 07/769,917 filed Sep. 30, 1991, now abandoned.

Figure 2:
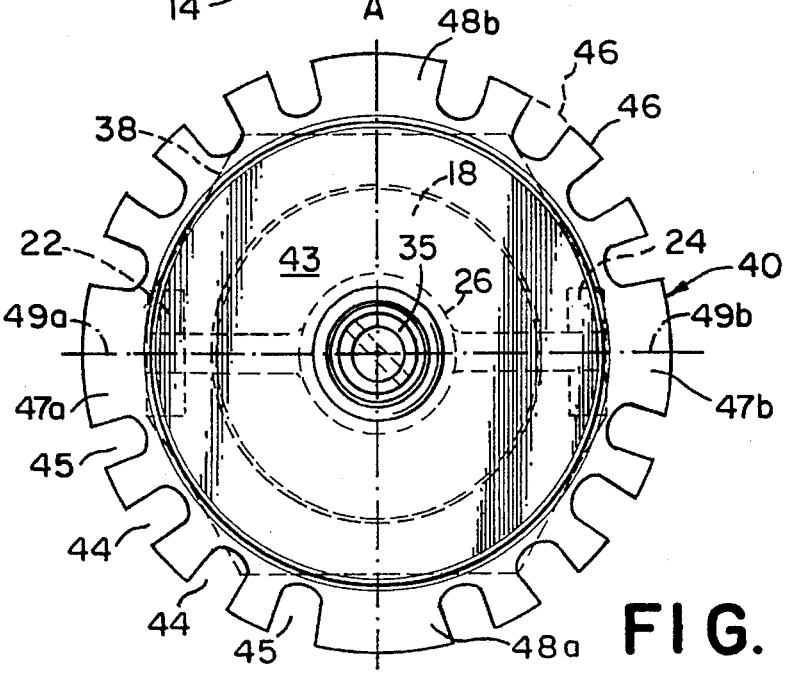
FIG. 2 is a top plan view of FIG. 1.

Referring to FIGS. 1 and 2 there is shown a preferred embodiment, frame-type automatic ceiling sprinkler in an upright configuration indicated generally at 10. Upright sprinkler 10 includes a one-piece frame 11 formed by a generally tubular body 12 with integral, adjoining yoke 20 and a separate deflector 40. The same frame 11 is preferably used with a preferred embodiment, automatic ceiling sprinkler in a pendent/recessed pendent configuration, which is indicated generally at 110 in FIGS. 5 and 6.

Body 12 defines a passageway 13 having one open end 14 defining an inlet and an opposing open end 16 defining an outlet of the tubular body 12. The body 12 is conventionally provided with threading 36 to enable the inlet open end 14 to be screwed into a sprinkler fitting or stem (not depicted), which would extend from a pipe supporting and supplying water or other fire extinguishment liquid to the sprinkler 10 or 110. At least one and preferably several pairs of opposing, parallel, planar flange side surfaces, one of which is indicated at 38, are provided on the body 12 to apply a wrench to the sprinkler body 12 to secure it to the fitting or stem.

The yoke 20 is preferably integrally and monolithically formed by molding with the tubular body 12 and comprises two, mirror-image arms 22 and 24 which extend away from the outlet open end 16 of the tubular body 12 and longitudinally with respect to a discharge axis A—A of the sprinkler, which is also a central axis of the tubular body 12 and the inlet and outlet open ends 14 and 16. Preferably, arms 26 and 24 merge at a junction or knuckle 26 centered on the axis A—A. A plug 18 is located in the outlet open end 16 at least essentially closing the outlet open end 16 of the tubular body 12. In a wet sprinkler, plug 18 has no opening therethrough and seals the outlet open end 16 so as to permit the sprinkler 10 or 110 to be pressurized with water prior to actuation. In a dry sprinkler, plug 18 may be provided with a tiny opening to permit draining of any residual water condensation from the sprinkler. A plug retaining element indicated generally at 28 is positioned between the plug 18 and the junction 26 to releasably retain the plug 18 in the outlet open end 16. Element 28 is preferably a hollow, sealed glass bulb 29 filled with a thermally responsive liquid such as an alcohol based solution. The element 28 may be another type of thermally responsive, frangible device or any other suitable, thermally responsive or suitable, electrically operated release element of the type conventionally used with automatic ceiling sprinklers. These release elements are well known to those of ordinary skill in this art. The alcohol based liquid in element 28, when heated above a predetermined temperature greater than indoor ambient temperature, will burst the bulb 29 thereby releasing the plug 18 and actuating the sprinkler 10 or 110.

Suitable means such as a compression adjustment screw 34 may be threaded through the junction 26 against the hemispherical end of bulb 29 so as to provide a compressive force sufficient to seat the plug 18 in the outlet open end 16 closing that end of the sprinkler. A seat hollow **18*a* is provided in the center of the plug 18 to receive the pointed end of the bulb 29. A pintle 35 may further be received in the junction opening receiving the adjustment screw 34 to seal that opening and to identify the sprinkler 10** as having a very extra large orifice.

Figure 7:
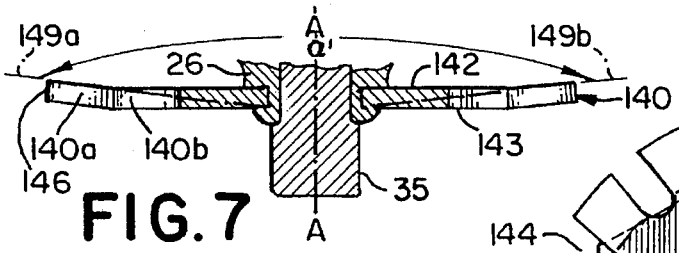
FIG. 7 is a sectional view taken along the lines 7—7 in FIG. 6.
Figure 6:
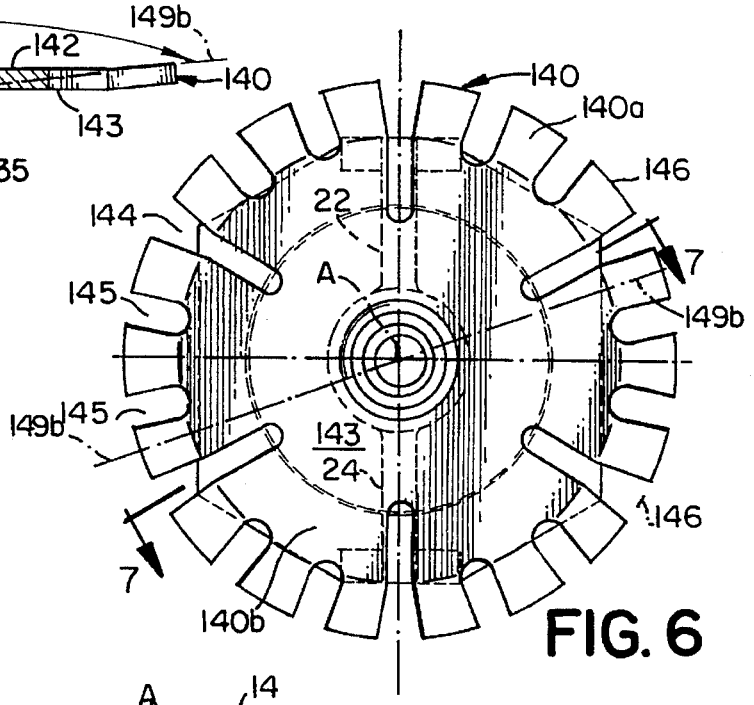
FIG. 6 is a bottom plan view of FIG. 5.
Figure 5:
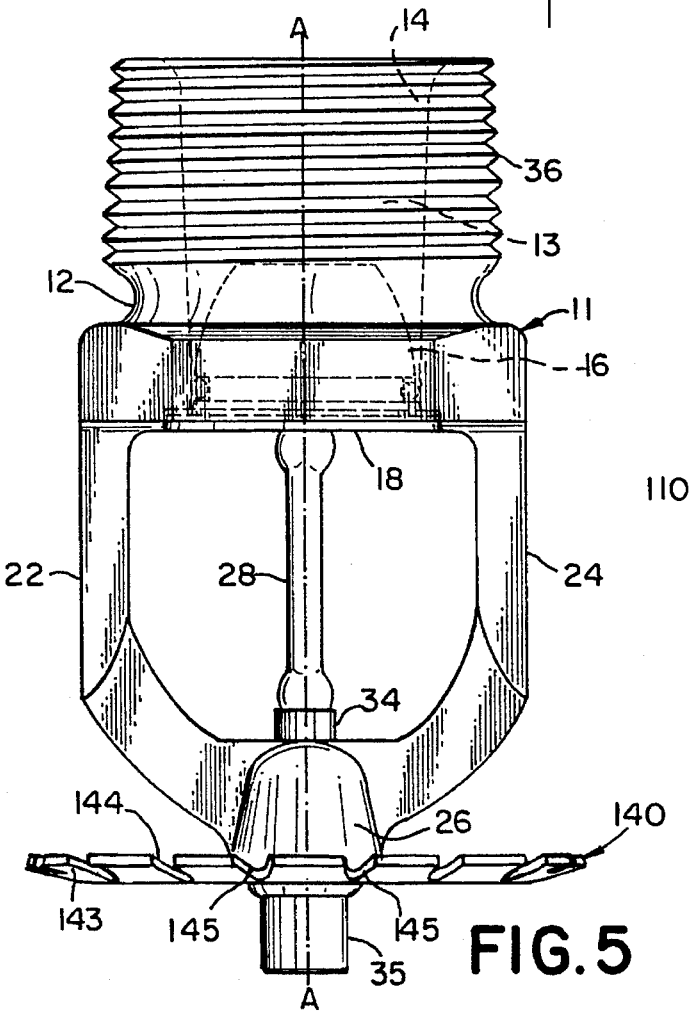
FIG. 5 is a side elevational view of a pendent extended coverage ordinary hazard automatic sprinkler.
Figure 8:
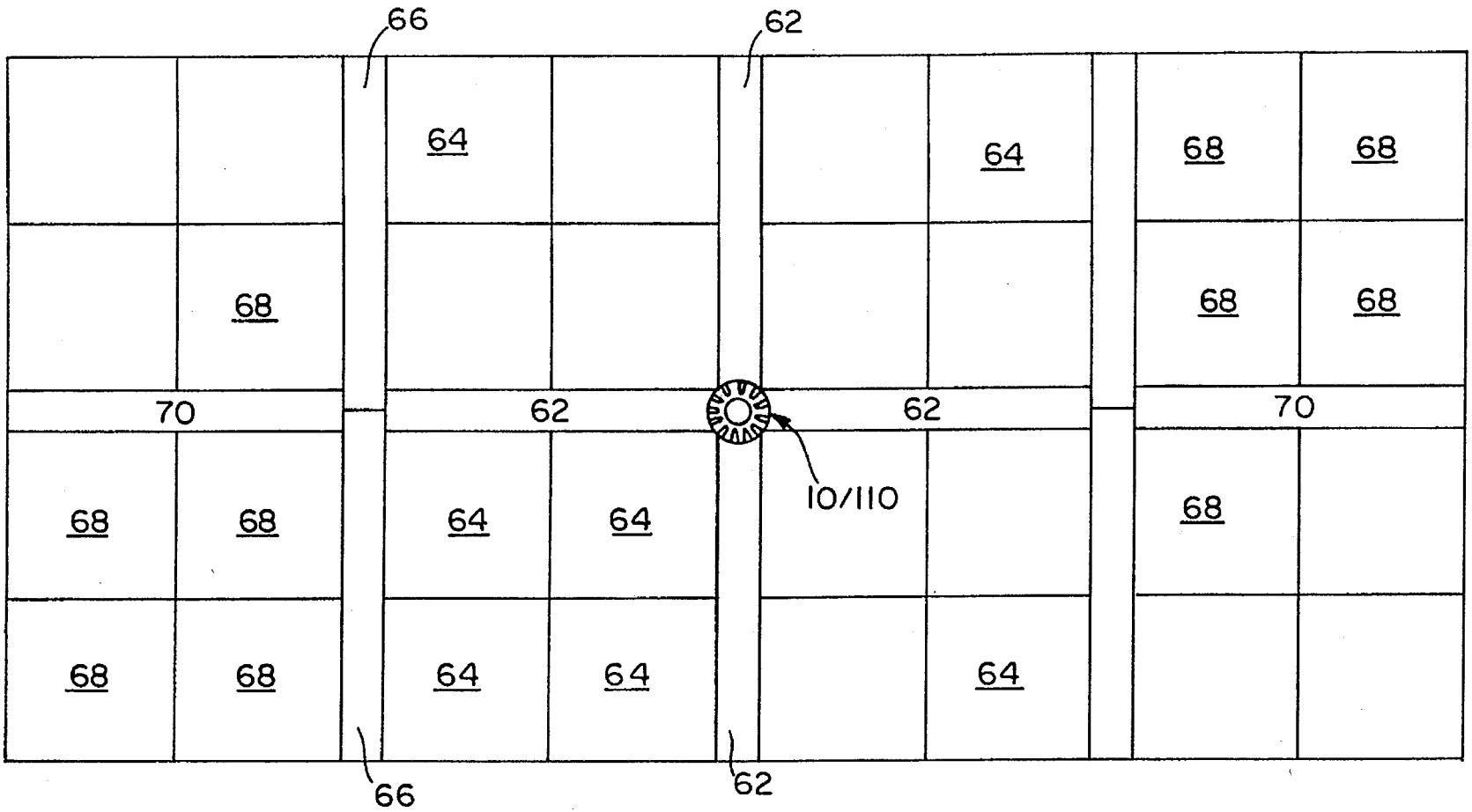
FIG. 8 is a collection area layout for a water distribution test.

Each deflector 40 of FIGS. 1–3 and 140 of FIGS. 5–7 forms part of a deflecting structure on the outlet open end 16 of the sprinkler tubular body 12. The deflecting structure further includes the junction 26 and the exposed concave end of adjustment screw 34, which normally receives the hemispherical end of bulb 29, and the adjoining portions of the arms 22 and 24, which are contacted by the water column discharging from the outlet open end 16 of the tubular body when the sprinkler 10 is activated. Preferably each deflector 40 or 140 is mounted to the frame 11 in a conventional fashion such as by being swaged to a remote end of the junction 26.

Each deflector 40 and 140 has a pair of opposing, mirror image major surfaces 42/43 and 142/143, respectively. Surfaces 42, 142 face towards and while surfaces 43, 143 face away from the outlet open end 16 of the tubular body 12. Other portions of the deflecting structure hold the deflector 40 or 140 with its major surface 42 or 142 facing, spaced from and generally aligned with the outlet open end 16 of the tubular body 12 such that the central axis A—A of the tubular body 12 is also a central axis of the deflector 40 or 140.

Sprinklers 10 and 110 differ from other prior art, frame-type ceiling sprinklers in the combination of the configuration of their deflectors 40 and 140 and the size of their orifice. One aspect of the present invention is the use of sprinkler bodies with at least "extra large" and preferably "very extra large" orifice sizes with higher K factors. In particular, sprinkler bodies of the present invention have nominal orifices (minimal internal) diameters and K factors greater than those of standard and even large orifice sprinklers originally used for extended coverage or ordinary hazard protection. Large orifice sprinklers have nominal diameters of about 17/32 inch and K factors of about 7.4 to 8.2±5 percent (or a maximum K factor of 8.7). Extra large orifices are greater than 0.6 inches in diameter, nominally about ⅝ inches (0.625 inches) to about 0.64 inches in diameter, while "very extra large" orifices are about 0.70 inches in diameter. Current Underwriters Laboratories, Inc. definitions of "extra large" and "very extra large" orifices, as would be known to those of ordinary skill in this art, apply. Extra large orifices provide K factors of between about 11 and about 12 (11.2–11.4 being typical) and while provided by very extra large orifices are between about 14 and about 15, (14.0–14.5 being typical). The K factor of a sprinkler tubular body equals the flow of water in gallons per minute through the tubular body divided by the square root of the water fed to the tubular body in pounds per square inch. Sprinklers with such extra and very extra large orifices are capable of supplying relatively larger volumes of water while minimizing the water pressures which must be provided to produce such flows. The benefits which arise from this relationship will be discussed in greater detail later in this description.

The preferred body 12 of the very extra large orifice sprinkler 10 has a nominal height of about 1.05 inch with an internal passageway having an inlet diameter of about 0.76 inches and tapering conically downward at an included cone angle of about five degrees ± one degree to a nominal orifice diameter (i.e. minimum diameter) of about 0.70 inches near the outlet open end 16, where the nominal diameter is maintained for about 0.1 inch or more. The last approximately 0.05 inches of the preferred passageway 13 is configured as shown in FIG. 4 to meet the requirements for releasing the preferred plug 18. These include the provision of an outwardly flaring conical surface **13*a* following the nominal orifice and an annular spring seat 13*b* following the conical surface. The plug 18 preferably includes an O-ring 32, which forms a fluid seal in the nominal orifice area of the passageway 13 and a wave spring washer 33, which is trapped between seat 13*b* and an overlapping flange portion 18*b* of the plug 18. The washer 33 helps to eject the plug 18 when the passageway 13 when the sprinkler 10 is activated. As can be seen by comparing FIGS. 1 and 3, the plug 18 is asymmetrical in shape to enhance its instability when released so that it is not trapped against the deflecting structure by the water column after activation. The junction 26 is domed with its rounded end facing the plug 18. The junction extends about 0.35 inches beneath the deflector and is about 0.9 inches from the nearest end of the tubular body 12. The arms 24 and 26 are preferably thinned where they extend generally radially inwardly to the junction 26. The shapes of the arms 22, 24 and junction 26 minimize disruption of the water column issuing from the outlet open end 16 when the sprinkler 10** is activated.

Sprinkler deflectors of the present invention have nominal outer diameters greater than the width of the water column issuing from the outlet open end 16 but less than 1.7 inches. Suggestedly, at least twelve and, preferably, about sixteen or more angularly spaced slots are provided. Longer slots are preferably combined with shorter slots. Each of the slots extends axially entirely through the deflector and generally radially inwardly from a curvilinear preferably circular outer perimeter of the deflector. The widths of the slots may be uniform or vary, Suggestedly, the deflector have slotless central areas which are at least five hundredths of an inch more in diameter greater than the nominal orifice diameter of the tubular body 12. Preferably, too, the total open area provided by the slots in a plane perpendicular to the central axis A—A of the deflector is at least ten percent (10%) and no more than thirty percent (30%) of the net deflector area, total area in the plane surrounded by the circular outer perimeter of the deflector less the area of the slots within the perimeter. Stated another way: 10% ≦[slot area]/[circular perimeter area-slot area]≦30%.

Figure 3:
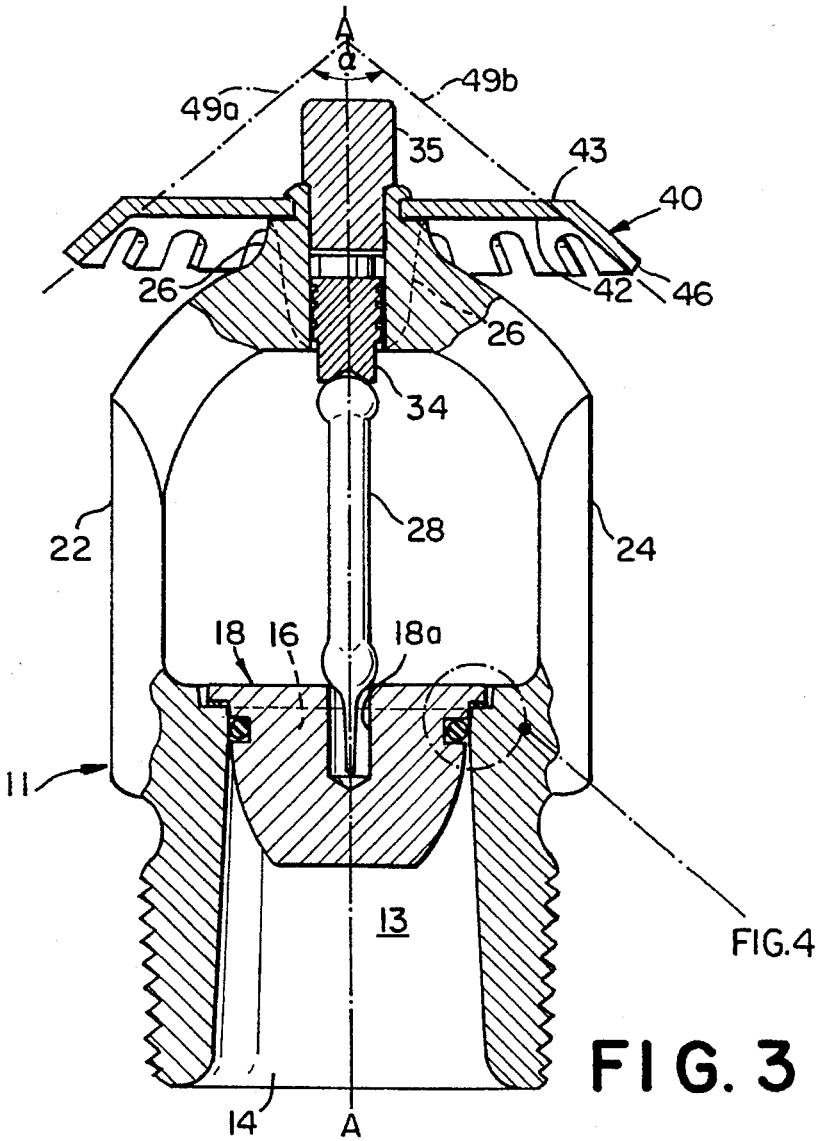
FIG. 3 is a partially broken away view of the sprinkler of FIG. 1 rotated 90° from the view of FIG. 1.
Figure 4:
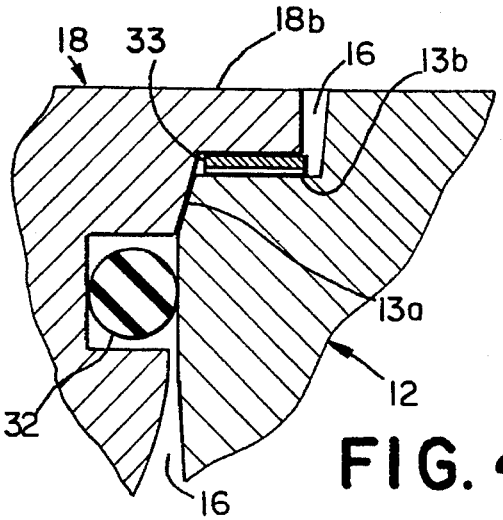
FIG. 4 is a magnified view of the encircled area 4 in FIG. 3.

As indicated in FIGS. 1 through 3, the invention incorporated into upright ceiling sprinklers 10 by coning an outermost annular portion **40*a* of the deflector 40 at a cone angle alpha (α) of between about eighty degrees and about one hundred degrees and, more preferably, about ninety degrees facing the outlet open end 16 of the tubular body 12. More particularly referring to FIG. 3, an opposed pair of imaginary projections 49*a* and 49*b* extended tangentially from the major side 42 of the deflector 40 facing the outlet open end 16, between adjoining pairs of the slots 44 and/or 45 on diametrically opposing sides of the deflector 40, intersect one another at about the central axis A—A of the deflector 40 and define the angle alpha (α) facing the outlet open end 16 of the tubular body 12**. An α angle of about 90° provided the optimum desired extended coverage water distribution. At angles below about 80° and above about 100°, that distribution was lost.

Preferably, slots 44, 45 extend generally radially inwardly from the outer perimeter 46 of the deflector 40 along much to most of the length of the fructoconical portion 40*a*. The slots 44, 45 also extend axially entirely through the deflector. The deflector 40 preferably has sixteen angularly spaced slots, each nominally about 0.125 inches in width. The slots 44, 45 are preferably divided into four groups with each group separated from the others by two pairs of diametrically opposed solid sectors 47*a*/47*b*, 48*a*/48*b* provided at 90° intervals. Preferably the slots of each group are separated from one another at the outer perimeter 46 by the same 0.125 width of each slot 44, 45, with the four sectors 47*a*/47*b* and 48*a*/48*b* occupying the remainder of the perimeter 46. As best seen in FIG. 2, sectors 47*a*/47*b* are aligned with frame arms 22, 24 and sectors 48*a*/48*b* are oriented perpendicularly with respect to a plane defined by the arms 22, 24.

Pairs of longer slots 44 preferably flank pairs of shorter slots 45 in each group. Preferably the longer slots 144 extend radially inwardly about 0.165 inches from the outer periphery of a flat blank originally 1.6 inches in outer diameter, yielding a slotless central area 1.27 inches in diameter before coning. The shorter slots 45 extend radially inwardly about 0.15 inches before coning. The asymmetric angular spacing of the slots 44, 45 providing solid sectors 47*a*/47*b*, 48*a*/48*b* and the asymmetric lengths of the slots 44, 45 all contribute to the substantially uniform distribution of water or other fire extinguishing liquid over the range of protection areas of sprinkler 10.

The frustoconical outer annular portion 40*a* surrounds an essentially flat annular portion 40*b*, which is centered on and oriented perpendicularly to the central axis A—A, as shown in FIG. 3. The flat portion 40*b* is at least about one inch in outer diameter and preferably about 1.2 inches in outer diameter. The slotless central area of the deflector 40 is slightly larger than 1.2 inches in outer diameter but still less than 1.3 inches.

After coning, deflector 40 has an outer perimeter diameter of 1.527 while slots 44 and 45 have lengths perpendicular to central axis A—A of about 0.109 and 0.106 inches, respectively. The ratio of perimeter outer diameter to radial slot length (0.109, 106) is about 14 while the ratio of the slot area to net deflector area is about 0.116 or 11.6%.

Sectors 47*a*, 47*b* and 48*a*/48*b* tend to shield adjoining sprinklers 10 on the same supply line and on adjoining supply lines when the sprinklers 10 are installed in rectangular or square patterns on such lines to prevent the discharge of each sprinkler from tending to strike the adjoining sprinklers. Sprinklers 10 are suggestedly installed with arms 22, 24 parallel with the supply pipe supporting the sprinkler. As a result, minimum acceptable spacing between adjoining upright sprinklers 10 such that the adjoining sprinklers do not prevent one another from activating, has been reduced to eight feet (or four feet from an adjoining wall where there is no adjoining sprinkler). Sprinklers 10 can be used together at any spacing from 8×8 feet (8 feet apart from one another on the same supply pipe and 8 feet between immediately adjoining side by side parallel supply pipes supporting sprinklers protecting the same open area) up to 20×20 feet. In particular, sprinklers 10 can be spaced at 8, 12, 16 and 20 ft. intervals in tile ceiling occupancies.

Minimum design pressures have been set for sprinklers 10 for 14×14 ft. (196 sq. ft.) protection areas at all ordinary hazard densities between 0.15 and 0.21 GPM/ft$^2$. These minimum pressures range from about 4 to about 8 PSI. Thus, minimum pressures of between about 4 PSI (for 0.15 GPM/ft$^2$) and 8 PSI (for 0.21 GPM/ft$^2$) should be provided for all spacings between 8×8 and 14×14 feet. Minimum design pressures are thereafter specified at two foot intervals (i.e. 16×16, 18×18 and 20×20 feet) for each predetermined ordinary hazard density (0.15, 0.16, 0.19, 0.20 and 0.21 GPM/ft$^2$) up to a maximum of 33.6 PSI for 0.21 GPM/ft.$^2$ at 20×20 feet.

The presently preferred pendent/recessed pendent extended coverage ordinary hazard automatic ceiling sprinkler 110 depicted in FIGS. 5 and 6 uses the previously described frame 11 with tubular body 12 having a nominal orifice diameter of about 0.7 inches providing a nominal K factor of between about 14 and about 15 (typically 14.5), in combination with an essentially flat circular deflector 140, preferably having eighteen longer and shorter slots 144 and 145, each extending axially through the deflector 140 and radially inwardly from the circular outer perimeter 146 of the deflector 140 about 0.377 and 0.192 inches, respectively, before a slight coning is provided to an originally flat deflector blank having an original outer perimeter diameter of about 1.5 inches. Shorter slots 45 are nominally 0.093 inches in width. Longer slots 44 taper down in width from about 0.093 to about 0.062 inches for the first 0.192 inches of slot depth then maintain that latter width for the remainder of the slot depth. Adjoining pairs of shorter slots 145 are separated by longer slots 144 with the eighteen slots 144, 145 being uniformly spaced around the circular outer perimeter 146 of the deflector 140. Spacing between the outlet open end 16 and facing surface 142 of the deflector is again nominally about one and one-quarter inches.

Essentially flat annual portion 140*b* is surrounded by frustoconical outer annular portion 140*a* including substantially all of the depth of the shorter slots 145. Planar portion 140*b* is preferably about 1.2 inches in diameter. The slotless central area is smaller, only 0.75 inches in diameter, but still larger than the nominal orifice diameter of 0.70 inches. Again, an opposed pair of imaginary projections 149*a* and 149*b* extended tangentially from the major side 142 of the deflector 140 facing the outlet open end 16 between adjoining pairs of the slots 144 and/or 145 on diametrically opposing sides of the deflector 140 intersect one another at the central axis A—A of the deflector 140 and define an angle α facing the outlet open end 16 of the tubular body 12. Angle α is suggestedly between about 165° and about 170° and preferably about 167°.

After coning the deflector 140 still has a perimeter outer diameter of about 1.5 inches. Slots 144 and 145 have radial depths perpendicular to central axis A—A of about 0.38 and about 0.19 inches, respectively. Outer diameter to slot depth ratios are about 4.0 and 8.0, respectively. The ratio of slot area to net deflector area is about 0.246 or 24.6%.

This deflector 140 provides protection for ordinary hazard occupancies delivering minimum water densities of from 0.15 to 0.21 GPM/ft$^2$, with minimum spacings of nine feet and maximum spacing of up to twenty feet between adjoining pairs of sprinklers 110 (and from four and one-half feet up to ten feet from any sprinkler to any adjacent wall), for minimum and maximum protection areas of from eighty-one (9×9 feet) to four hundred (20×20 feet) square feet per sprinkler 110. This protection is provided for placement of the sprinkler deflectors 140 at heights of from seven and one-half feet down to only eighteen inches above a protection area beneath the sprinkler 110. Again, this protection is provided for minimum design pressures ranging from between about 4 to about 8 PSI for selected densities of between 0.15 and 0.21 GPM/ft.$^2$ over protection areas of 196 (14×14) square feet and below per sprinkler, to minimum design pressures ranging from between about 17 PSI to about 34 PSI for selected densities between 0.15 and 0.21 GPM/ft.$^2$ over protection areas of 400 (20×20) square feet.

Both pendent and upright sprinklers have passed Underwriters Laboratories test for listing under Underwriters Laboratories' Standard UL 199. Moreover, sprinkler 110 in the pendent/recessed pendent installation configuration has also passed UL test requirements for extended coverage light hazard protection. In obtaining a UL listing, sprinklers of the present invention are subject to distribution tests in which four identical sprinklers are installed so as to define a square having dimensions of the protection area of each sprinkler, each of the sprinklers being located at each of the four corners of the square. This arrangement includes two sprinklers each on two parallel supply lines. The sprinklers are installed with deflectors lying in a common plane about 7 inches below the lower deck or surface of a ceiling which is parallel to and at least co-extensive with the square defined by the four sprinklers. When the sprinklers are activated, water is projected by the four identical sprinklers onto a horizontal square area centered beneath and parallel to the plane defined by the sprinkler square. Each side of the centered square area has a length which is 6 feet shorter than the length of each side of the sprinkler square. Distribution tests are performed with the deflectors located at 7½ and 3 feet above the collection area. Sprinklers are tested at ordinary hazard densities. Those densities are currently 0.15 and 0.20 GPM/ft.$^2$. It is also possible to test such sprinklers prior to ordinary hazard densities which were 0.16, 0.19 and 0.21 GPM/ft.$^2$.

For testing at the 7½ ft. height the sprinklers are pressurized to provide a flow rate in gallons per minute (GPM), which is equal to the selected ordinary hazard density being tested (0.15 or 0.20) times the area of the sprinkler square. The four sprinklers are operated and the discharge is collected in foot square pans located in the collection area. In distribution tests with deflectors located at 7½ feet above the collection area, the average density collected in the entire collection area must be equal to the selected discharge density (e.g. 0.15 or 0.20 GPM/ft.$^2$), the average density collected in any four-by-four ft. area shall be 0.11 GPM/ft.$^2$ for the 0.15 GPM/ft.$^2$ discharge density and 0.15 GPM/ft.$^2$ for the 0.2 GPM/ft.$^2$ density and the minimum water collected in any foot square collection pan in the entire area cannot be less than 50% of the selected discharge density of 0.15 and 0.20 GPM/ft.$^2$.

For testing at 3 ft. heights of the deflectors above the collection area, the average density collected in the entire collection area shall again be the selected discharge density of 0.15 or 0.20 GPM/ft.$^2$, the average density collected in any four-by-four ft. portion of the collection area must be at least 0.08 and 0.11 GPM/ft.$^2$ for the selected 0.15 or 0.20 GPM/ft.$^2$ discharge density, and each foot square pan within the collection area must collect at least 0.03 GPM. U.S. Pat. No. 5,366,022 contains further information regarding such testing.

The sprinkler 110 in pendent configuration has also successfully completed testing for approval by Factory Mutual for extended coverage ordinary hazard installations. A number of tests were involved including water distribution tests with and without fire. Distribution tests were performed with one, two and four identical sprinklers.

FIG. 9 depicts schematically a floor plan for an FM water distribution test. Single sprinkler 10 or 110 is centered at the intersection of four flues 62, extended perpendicularly to one another from the sprinkler. Each flue is 6 inches wide and at least 42 inches long. Adjoining pairs of the flues 62 separate subsets of four collection pans 64, from one another. Each pan 64 is 21 inches square. In addition, pairs of flues 66, each again 6 inches wide and 45 inches long separate four additional subsets of four collection pans each 21 inches square, which are designated by reference numeral 68 to distinguish them from the pans 64 in the area immediately surrounding the sprinkler. Flues 70 each 42 inches long and 6 inches wide separate subsets of the collection pans 68. The flues 62 and collection pans 64 constitute a center area while the remaining flues 66 and 70 and collection pans 68 constitute prewetting areas.

For a single upright, very extra large orifice, extended coverage ordinary hazard sprinkler 10, the sprinkler 10 is located on a pipe spaced one foot from a flat smooth ceiling above the sprinkler 10 and the collection pans and flues are positioned 3½ feet below the ceiling. The one sprinkler 10 is pressurized to provide a flow rate of 60 GPM. Average water density in the center area provided by flues 62 and pans 64 must be greater than or equal to 0.075 GPM/ft.$^2$. Each of the sixteen pans 64 and four flues 62 in the center area must receive at least 0.02 GPM/ft.$^2$ and each of at least ten of the pans 64 and each of the four flues 62 must receive at least 0.07 GPM/ft.$^2$. Moreover, average water density collected in the prewetting areas defined by flues 66, 70 and pans 68 must be at least 0.075 GPM/ft.$^2$ while the minimum density collected by each of the sixteen pans 68 and the six flues 66, 70 must be at least 0.02 GPM/ft.$^2$ and while at least ten of the pans 68 all flues 66 and 70 must each receive at least 0.09 GPM/ft.$^2$.

The test for a pendent very extra large orifice, extended coverage ordinary hazard sprinkler 110 requires the sprinkler 110 to be mounted from a pipe spaced 2.5 inches from the smooth ceiling. When water is supplied at a rate of 60 GPM, average collected density in the center area defined by flues 62 and pan 64 must be at least 0.09 GPM/ft.$^2$. Furthermore, each of the sixteen pans 64 and four flues 62 must collect at least 0.03 GPM/ft.$^2$ and at least ten of the pans 64 and all four flues 62 must each collect at least 0.09 GPM/ft.$^2$. Average water density in the prewetting area defined by sixteen pans 68 and six flues 66, 70 must be at least 0.07 GPM/ft.$^2$ with each of the sixteen pans and six flues collecting at least 0.02 GPM/ft.$^2$ and at least ten of the pans 68 and all of the flues 66, 70 each collecting at least 0.07 GPM/ft.$^2$.

Sprinkler 110 in pendent and recessed pendent configurations has also satisfied Underwriters Laboratories listing requirement for extended coverage light hazard for protection areas up to 20×20 feet (400 sq. ft.) with minimum spacing of 9 feet between adjoining sprinklers on the same supply line and between adjoining supply lines in the same coverage areas. Minimum design pressure is 3.2 PSI are required for spacings of 16×16 feet or less. Minimum design pressure for maximum 20×20 feet coverage area is only 7.6 PSI. This light hazard listing is for smooth flat horizontal ceiling. Sprinkler 110 can provide light hazard protection over the maximum protection area (20×20 feet) at a minimum pressure (7.6 PSI), which is less than half of the minimum pressure required to provide 15×15 feet of light hazard, extended coverage protection with a sprinkler having a standard (½ inch) orifice.

Sprinklers 10, 110 are installed in accordance with the current Standard for the Installation of Sprinkler Systems, NFPA-13, issued by the National Fire Protection Association, or the current Factory Mutual Guidelines for the Installation of Very Extra Large Orifice Extended Coverage Ordinary Hazard Ceiling Sprinklers, each of which are incorporated by reference herein. In accordance with that standard and guideline, sprinklers 10 and 110 can be installed in either unobstructed or non-combustible obstructed construction. At least five of the sprinklers 10 or 110 must be coupled together along the same supply line or along coupled together supply lines.

This invention offers an economical means and method of achieving extended coverage fire protection for ordinary hazard occupancies which can further reduce the net cost of and simplify providing such extended coverage protection. The costs of manufacturing sprinklers of the present invention are typical to the costs of manufacturing standard orifice sprinklers. However, extended coverage will, in most installations, require fewer sprinklers and branch lines, and obviate the need to provide pressure-boosting pumps. The avoidance of the use of booster pumps entirely is itself a significant economic advantage of the present invention. However, the majority of the installed cost of a sprinkler system lies not in the cost of the components, but in a manpower cost of installation. Sprinklers and sprinkler systems of the present invention offer the potential of significant reductions in such costs, since, in many if not most cases, fewer sprinklers and fewer branch lines are needed to provide protection in any given area.

The benefits of the present invention further carry over in the use of these sprinklers in light hazard occupancies where the extremely low minimum design pressure of less than 8 PSI are required per sprinkler for 400 sq. ft. coverage (twenty-by-twenty), which permits the use of such sprinklers in longer than normal runs, again without the need to augment or boost supply pressures.

While several specific configurations of preferred embodiments of the invention have been disclosed and modifications thereto suggested, it will be recognized by those skilled in the art that other changes may be made to the invention without departing from the broad inventive concepts thereof.

For example, while a frame-type sprinklers are disclosed, one of ordinary skill in the art will appreciate that the teachings of the present invention can be incorporated into drop-down type ceiling sprinklers of the various types described, for example, in U.S. Pat. Nos. 4,014,388, 4,491,182, 4,508,175, 4,618,001, 4,630,688, 4,976,320, 5,083,616, and 5,094,198, each assigned to the assignee of this application and incorporated by reference herein.

One of ordinary skill will further appreciate that having demonstrated the ability to distribute water with adequate densities over such extended areas with the disclosed deflectors, that it would be possible to distribute water with other deflector configurations. Most simply, the relative dimensions of the disclosed deflectors can be varied simply by varying the spacing of the deflector from the proximal sprinkler body end. However, it is believed that all subsequent versions of this invention will adopt a generally horizontal spray pattern of large droplets which characterize the distribution patterns of the preferred deflectors and sprinklers of the present invention.

It is further suggested that thermally responsive elements used in the sprinkler be selected to provide the quickest response times possible to activate the sprinklers as quickly as possible after the beginning of a fire. It is suggested that the temperature responsive element have a response time index ("RTI") of less than one hundred and preferably less than fifty. It is believed that such a response time index can be achieved in several ways, for example, by variations in the wall thicknesses of glass bulb release elements of the type previously noted.

Sprinklers 10 provide ordinary hazard extended coverage protections from deflector heights of at least seven and one-half feet down to only eighteen inches above the tops of commodities defining the protection area being covered.

It should be understood, therefore, that this invention is not limited to the particular embodiments or instrumentalities shown, but is intended to cover all modifications which are within the scope and spirit of the invention as defined by the appended claims.

We claim:

1. An extended coverage ceiling sprinkler comprising:

a generally tubular body having an inlet open end and opposing, outlet open end, the tubular body having a minimum internal diameter greater than 0.65 inches and a K-factor of between about 14 and about 15, where the K-factor equals the flow of water in gallons per minute through the tubular body divided by the square root of the pressure of the water fed to the tubular body in pounds per square inch;

a plug at least essentially closing the outlet end of the tubular body;

an element releasably retaining the plug in the outlet end at least essentially closing the outlet end;

a deflector support extending axially away from the outlet end of the tubular body; and a deflector coupled to the tubular body through the deflector support, the deflector having a major surface facing, spaced from and generally aligned with the outlet open end of the tubular body, the deflector having a circular outer perimeter and an outer diameter of less than 1.7 inches and, as mounted with the deflector support, a central area without water passing openings therethrough, the central area of the deflector being at least 0.75 inches in diameter.

2. The sprinkler of claim 1 wherein the deflector outer diameter is less than 1.6 inches.

3. Ceiling sprinkler of claim 2 wherein the deflector outer diameter is about 1.5 inches.

4. An extended coverage ceiling sprinkler comprising:

a generally tubular body having an inlet open end and opposing, outlet open end, the tubular body having a minimum internal diameter greater than 0.6 inches and a K-factor greater than 9 and up to about 15, where the K-factor equals the flow of water in gallons per minute through the tubular body divided by the square root of the pressure of the water fed to the tubular body in pounds per square inch;

a plug at least essentially closing the opposing outlet end of the tubular body;

an element releasably retaining the plug in the outlet end at least essentially closing the outlet end;

a deflector support extending axially away from the one end of the tubular body; and a deflector coupled to the tubular body through the deflector support, the deflector having a major surface facing, spaced from and generally aligned with the outlet end of the tubular body, the deflector having a circular outer perimeter with a plurality of slots extending axially through the deflector and generally radially inwardly from the perimeter towards a central axis of the deflector and, as mounted with the deflector support, a slotless central area without water passing openings therethrough, the slotless central area of the deflector being at least 0.75 inches in diameter, wherein a ratio of the area of the slots in a plane perpendicular to the central axis is between ten percent (10%) and thirty percent (30%) of the total area in the plane surrounded by the circular outer perimeter less the area of the slots.

5. An extended coverage ceiling sprinkler comprising:

a generally tubular body having an inlet open end and opposing, outlet end, the tubular body having a minimum internal diameter greater than 0.65 inches and a K-factor of between about 14 and about 15, where the K-factor equals the flow of water in gallons per minute through the tubular body divided by the square root of the pressure of the water fed to the tubular body in pounds per square inch;

a plug at least essentially closing the opposing outlet end of the tubular body;

an element releasably retaining the plug in the outlet end at least essentially closing the outlet end;

a deflector support extending axially away from the outlet end of the tubular body; and a deflector coupled to the tubular body through the deflector support, the deflector having a major surface facing, spaced from and generally aligned with the outlet end of the tubular body, the deflector having a circular outer perimeter and an outer diameter of less than 1.7 inches with a plurality of slots extending axially through the deflector and generally radially inwardly from the perimeter toward a central axis of the deflector and, as mounted with the deflector support, a slotless central area without water passing openings therethrough, wherein a ratio of the deflector outer diameter to slot depth of at least one of the slots in a direction perpendicular to the central axis is greater than 10.

6. The ceiling sprinkler of claim 5 wherein the ratio is up to about 14.

7. An extended coverage ceiling sprinkler comprising:

a generally tubular body having an inlet open end and opposing, outlet open end, the tubular body having a minimum internal diameter greater than 0.6 inches and a K-factor of greater than 9 and up to about 15, where the K-factor equals the flow of water in gallons per minute through the tubular body divided by the square root of the pressure of the water fed to the tubular body in pounds per square inch;

a plug at least essentially closing the opposing outlet end of the tubular body;

an element releasably retaining the plug in the outlet end at least essentially closing the outlet end;

a deflector support extending axially away from the one end of the tubular body; and a deflector coupled to the tubular body through the deflector support, the deflector having a major surface facing, spaced from and generally aligned with the outlet end of the tubular body, the deflector having a circular outer perimeter with a plurality of slots extending axially through the deflector and generally radially inwardly from the perimeter toward a central axis of the deflector and, as mounted with the deflector support, a slotless central area without water passing openings therethrough, the slotless central area of the deflector being at least 0.75 inches in diameter, and diametrically opposed pairs of imaginary projections extended tangentially from the deflector between adjoining pairs of slots on diametrically opposing sides of the major surface of the deflector facing the outlet open end, the projections intersecting one another at about the central axis and defining an angle facing the outlet end of the tubular body of between about 80° and about 100°.

* * * * *